United States Patent [19]

Jencks et al.

[11] Patent Number: 4,690,126

[45] Date of Patent: Sep. 1, 1987

[54] CATALYTIC COMBUSTION ASSEMBLY FOR WOOD-BURNING STOVE

[75] Inventors: David R. Jencks, Rogue River; Mark R. Nelson, Medford, both of Oreg.

[73] Assignee: Orley's Manufacturing Co., Inc., White City, Oreg.

[21] Appl. No.: 885,425

[22] Filed: Jul. 14, 1986

[51] Int. Cl.[4] ..... F24C 1/14

[52] U.S. Cl. ..... 126/77; 126/83; 126/289; 422/176; 422/200; 110/203; 110/214

[58] Field of Search ..... 126/77, 112, 60, 61, 126/80, 290, 291, 83, 67, 289, 163 R; 110/203, 208, 209, 214; 422/177, 180, 200, 176, 174

[56] References Cited

U.S. PATENT DOCUMENTS

| | | | |
|---|---|---|---|
| 4,319,556 | 3/1982 | Schwartz et al. | 126/77 |
| 4,330,503 | 5/1982 | Allaire et al. | 126/77 |
| 4,437,451 | 3/1984 | Wysong | 126/77 |
| 4,476,852 | 10/1984 | Lee et al. | 126/289 |
| 4,479,921 | 10/1984 | Allaire et al. | 110/203 |
| 4,502,395 | 3/1985 | Barnett | 126/77 |
| 4,549,524 | 10/1985 | Albertsen et al. | 126/77 |
| 4,550,668 | 11/1985 | Pointkowski | 110/210 |

OTHER PUBLICATIONS

Riteway's Uni-Com advertisement.
Versagrid Catalytic Convertor Kit advertisement.

*Primary Examiner*—James C. Yeung
*Attorney, Agent, or Firm*—Klarquist, Sparkman, Campbell, Leigh & Whinston

[57] ABSTRACT

A catalytic combustor assembly includes a housing containing a catalytic combustor for insertion into the firebox of an existing stove. The housing engages and hermetically seals against the ceiling of the firebox surrounding the flue outlet of the stove to define an airtight passageway for volatile gases from the firebox to the flue outlet. The housing further defines a pair of secondary combustion air inlets and connected conduit for heating and then directing secondary air into the defined passageway to mix with the volatile gases upstream of the catalytic combustor. A bypass door is also mounted within the housing for selectively allowing the volatile gases to bypass the combustor in passing from the firebox to the flue outlet.

5 Claims, 6 Drawing Figures

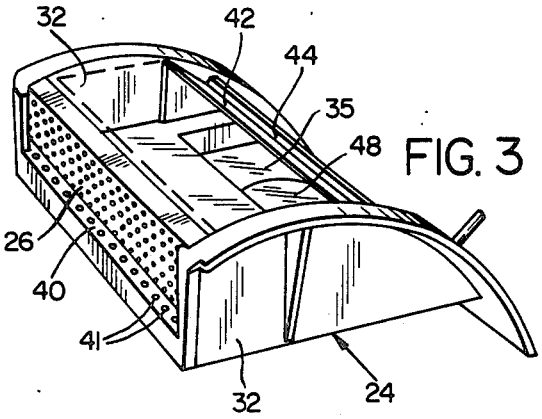
FIG. 3
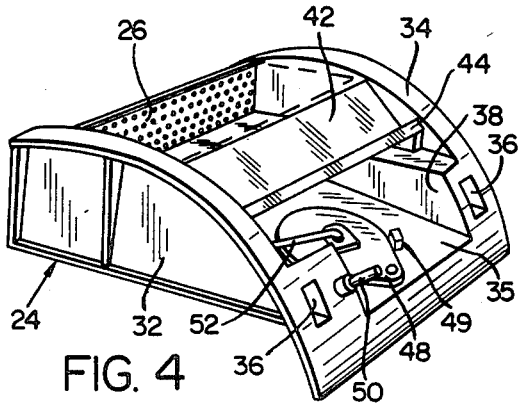
FIG. 4
FIG. 5
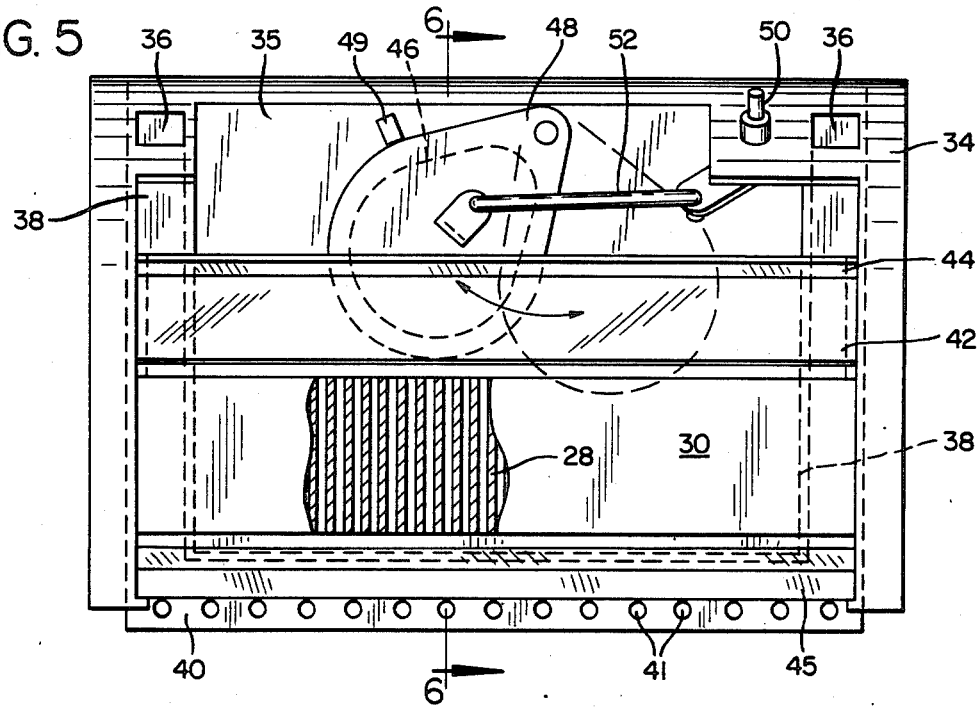
FIG. 6
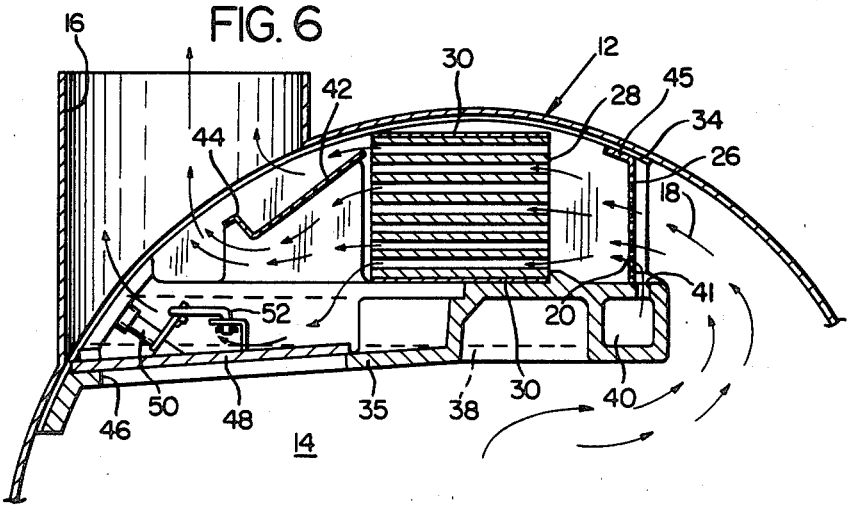

CATALYTIC COMBUSTION ASSEMBLY FOR WOOD-BURNING STOVE

BACKGROUND OF THE INVENTION

This invention relates to catalytic combustors for wood-burning stoves. More particularly, this invention relates to a catalytic combustor assembly that can be mounted to an existing stove.

The use of wood stoves has boomed in recent years as the burning of wood has become a viable alternative to electricity, gas, and oil for heating homes. With increased wood burning in urban areas, however, has come a corresponding increase in air pollution, especially in unburnt hydrocarbons found in smoke. In some locations, the smoke from wood stoves is now of such major concern that legislation has been passed to limit smoke emissions. In Oregon, for example, recent state legislation applicable to new stoves imposes a limit on the grams of smoke per hour that a wood stove may emit.

Most conventional wood stoves cannot meet the statutory emission limitations imposed by such legislation because these stoves cannot heat the volatile gases comprising the smoke sufficiently to burn the gases completely. These products will burn completely only if raised to a much higher temperature. In response to this need, the technology has developed catalytic combustors that are instaled within wood-burning stoves at the time of manufacture. Typically, the combustor comprises a noble metal catalyst mounted on a ceramic substrate. The catalyst lowers the ignition temperature of the hydrocarbons and thus temperature needed in the stove. As the hydrocarbons burn, they raise the temperature of the catalyst and substrate, which correspondingly increases the catalytic activity. New stoves that are manufactured with catalytic combustors built integrally within the stove firebox are disclosed in U.S. Pat. No. 4,479,921 to Allaire et al. and U.S. Pat. No. 4,319,556 to Schwartz et al. The combustor is preferably positioned within the firebox to optimize the performance of the catalyst.

The drawback of designs such as disclosed in these patents, of course, is their sole application to newly manufactured stoves. They are not adaptable to existing stoves which number in the millions and are unlikely to need replacement for many years to come. Recognizing this drawback and the possibility of legislation mandatory retrofitting of existing stoves, add-on catalytic combustors have been developed for adding a catalyst to an existing stove. These add-on combustors take the form of a unit installed conveniently within the stove pipe of the stove beyond the flue outlet. Examples of such units include the devices disclosed in U.S. Pat. No. 4,550,668 to Piontkowski and U.S. Pat. No. 4,476,852 to Lee et al, the Uni-Com insert manufactured by Riteway Company and the VERSAGRID catalytic converter kit manufactured by Applied Ceramics, Inc., of Atlanta, Ga.

Although these insertable units provide a means for retrofitting existing stoves, the in-pipe design they utilize is inherently limited because of the distance of the catalyst from the center of combustion within the stove. First, the converter is not heated quickly when the stove is first fired. A significant amount of polluting smoke must then be diverted to bypass the catalyst until it is heated sufficiently to be effective. Secondly, a cooler catalyst does not burn the volatile gases sufficiently. Particulate matter within the gases can plate out on the catalyst and render it inoperative. Thirdly, a hotter and thus higher fuel-consuming fire is needed to heat the catalyst sufficiently.

In light of these shortcomings, a preferable design for an add-on catalytic combustor assembly is one that can be heated quickly and to a higher degree than existing combustors without requiring the building of a hotter fire.

SUMMARY OF THE INVENTION

An object of this invention, therefore, is to provide an improved catalytic combustor assembly for adding to existing wood stoves.

Another object of the invention is to mount the combustor assembly close to the fire so that the catalyst can be heated quickly with a relatively low temperature fire.

Another object of the invention is to mount the catalytic combustor within the firebox of an existing stove.

Yet another object of the invention is to improve the burning efficiency of the catalyst within the combustor assembly.

To achieve these objects, a catalytic combustor assembly includes a housing sized for insertion into the firebox of a stove. The housing engages the ceiling of the firebox surrounding the flue outlet of the stove to define a passageway for volatile gases from the firebox to the flue outlet. The housing further defines a secondary air inlet for directing secondary combustor air from outside the stove into the passageway to mix with the volatile gases passing therethrough. A catalytic combustor is mounted within the housing across the passageway to intercept the volatile gas-secondary air mixture and burn the gases more completely. A bypass means is also mounted within the housing for selectively allowing the volatile gases to bypass the combustor in passing from the firebox to the flue outlet.

The housing of the catalytic combustor assembly is adapted to be mounted in a stove at the time of the stove's manufacture or to be inserted into the firebox of an existing stove that lacks a catalytic combustor.

The catalytic combustor assembly may further include a mixing screen mounted across the defined passageway upstream of the combustor for mixing the volatile gases and secondary air and a baffle mounted across the passageway downstream of the combustor for slowing the mixture flow through the combustor.

The foregoing and other objects, features, and advantages of the invention will become more apparent from the following detailed description of a preferred embodiment which proceeds with reference to the accompanying drawings.

BRIEF DESCRIPTION OF THE DRAWINGS

FIG. 3 is a first perspective view of the combustor assembly of FIG. 1 with the catalyst removed for clarity.

FIG. 4 is a second perspective view of the combustor assembly of FIG. 1 with the catalyst removed for clarity.

FIG. 5 is a top plan view of the combustor assembly of FIG. 1.

FIG. 6 is a cross-sectional view of the combustor assembly of FIG. 1 taken along line 6—6 of FIG. 5.

DETAILED DESCRIPTION

Figure 1:
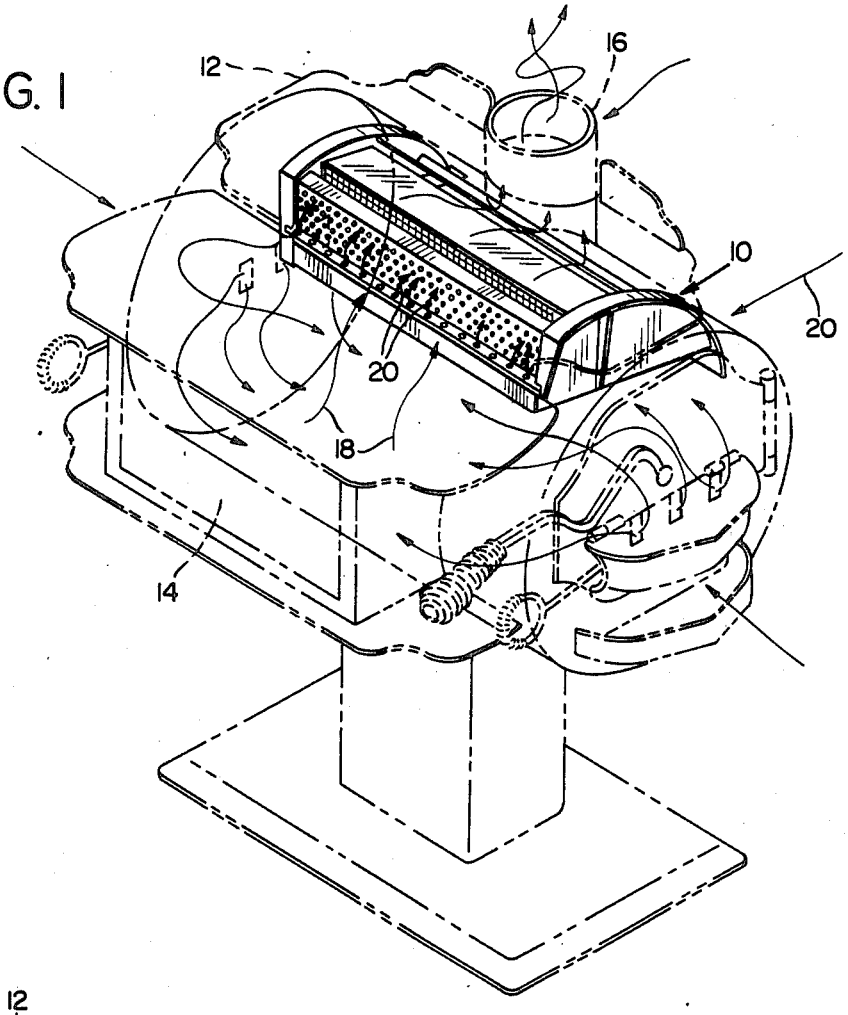
FIG. 1 is a perspective view of a catalytic combustor assembly according to the invention, shown within a wood-burning stove.

FIG. 1 shows a catalytic combustor assembly 10 constructed according to the invention and mounted within a conventional wood-burning stove 12 that includes a firebox 14 and a flue outlet 16. The assembly 10 is mounted against the ceiling of the firebox 14 surrounding the outlet 16 to direct the volatile gases produced by primary combustion in the firebox, indicated by arrows 18, through a catalyst before exiting the stove. The assembly 10 also enables secondary combustion air, indicated by arrows 20, to be drawn into the stove 12 to mix with the volatile gases for a cleaner, more efficient burn of the volatile gases by the catalyst.

Figure 2:
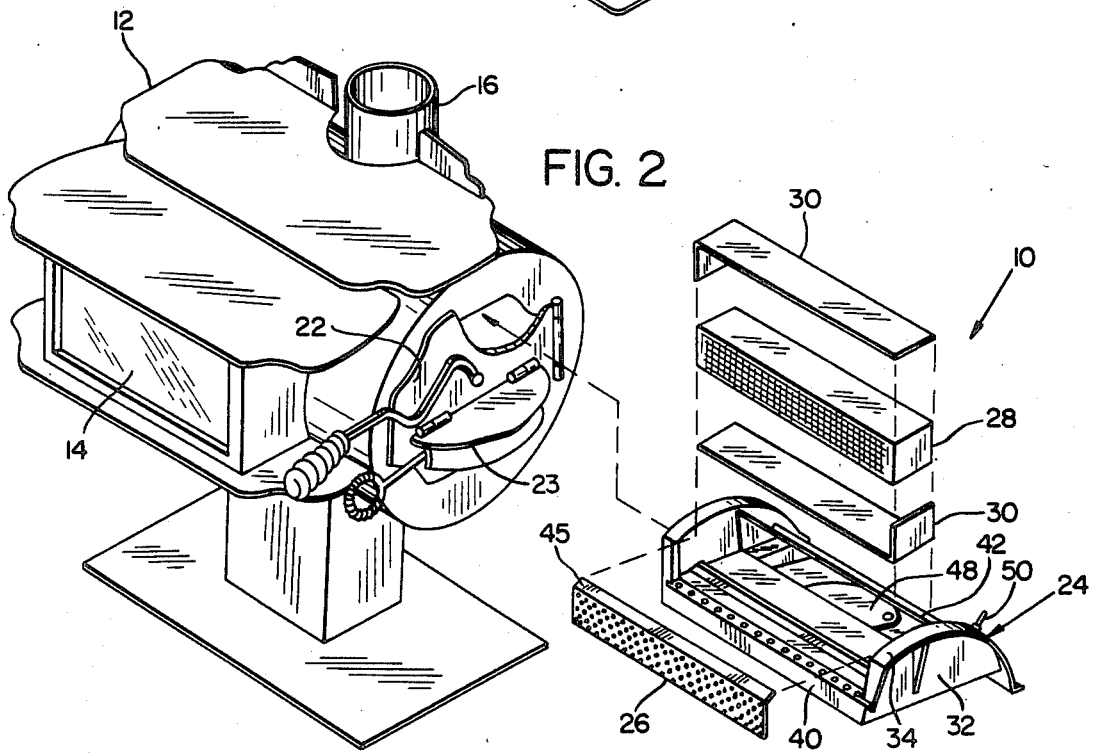
FIG. 2 is an exploded view of the combustor assembly of FIG. 1.

Referring to FIG. 2, the assembly 10 is sized to be mounted within the stove 12 at the time of the stove's manufacture or to be inserted and mounted as a retrofitting addition through a doorway 22 and an air inlet 23 of an existing stove. The assembly 10 includes a housing 24 for supporting a catalyst, a mixing screen 26 for mixing volatile gases with secondary air upstream of the catalyst, and a catalytic combustor 28 enclosed within a pair of complementary L-shaped shields 30 for burning the volatile gases.

FIGS. 3 and 4 show perspective views of the assembly 10 with the catalytic combustor 28 removed for clarity. The housing 24 comprises a pair of spaced-apart parallel walls 32 defining an airtight passageway from the firebox 14 to the outlet 26. The tops of the walls 32 are shaped to engage and hermetically seal against the ceiling of the firebox 14 surrounding the flue outlet 16. The seal itself may comprise a gasket-like adhesive material 34 for fastening the housing to the firebox 14. Other fastening means may, of course, be used, such as bolts and nuts. Completing the passageway is an inclined housing base 35 that directs the rising volatile gases toward the front of the housing 24 to flow between the walls 32 to the outlet 16. In this particular embodiment, the profile of the walls is rounded for fitting the housing 24 within a cylindrical firebox. For a rectangular firebox, the profile of the walls 32 would be shaped accordingly.

The housing 24 further defines a secondary air source for mixing secondary combustion air with the volatile gases before the gases are burned within the catalytic combustor 28. The source includes a pair of secondary air inlets 36 shown in FIG. 4 and a connected U-shaped secondary air conduit shown in FIG. 5. The secondary air inlets 36 align with similarly sized inlets in the rear wall of the firebox 14 to direct secondary combustion air from outside the stove 12 into the U-shaped conduit. The secondary air conduit has lateral conduit portions 38 running parallel inside the base of the walls 32 from the inlets 36 to a transverse conduit portion 40 running between the walls across the front of the housing 24 at the entrance of the defined passageway. The transverse conduit portion 40 contains a plurality of holes 41 on its passageway-side surface for releasing the secondary air to mix with the overpassing volatile gases, as shown in FIG. 6. The secondary air is heated as it is drawn through the lateral conduit portions 38 to improve the burning efficiency of the catalytic combustor 28 as it intercepts the volatile gas-secondary air mixture upstream of the flue outlet 16.

The efficiency of the catalytic combustor 28 is further improved by increasing the residency time of the gas-air mixture therein. A means for doing so comprises a baffle 42 mounted within the housing 24 to deflect the gas flow away from the outlet 16. The baffle 42 is secured to the opposing walls 32 across the defined passageway and below the outlet 16. The baffle 42 includes an upturned lip 44 on the baffle's downstream edge to define a route for the mixture flow underneath the baffle and up to the outlet 16.

The mixing screen 26 is a flat metal grating with circular holes and an upper flanged portion 45 for sealing against the gasket 34. The screen 26 is mounted across the entrance of the defined passageway adjacent to but downstream of the transverse conduit portion 40. The volatile gases rising from the firebox 14 are mixed by the screen 26 with the secondary air entering the defined passageway from the transverse conduit portion 40. The gas-air mixture that results is dispersed evenly across the catalytic combustor 28. The screen 26 also acts as a means for shielding the catalytic combustor 28 from contact with flames in the firebox 14.

Because of the flow restriction causes by the combustor 28 mounted across the defined passageway, a bypass means is included in the assembly 10. The bypass means is used to prevent smoke from escaping through the stove doorway 22 when the stove doorway is open and to assist in the start of a fire by creating a strong draw within the stove 12 at initial combustion. Referring to FIG. 5, the bypass means comprises a bypass opening 46 defined within the base 35 of the housing 24 and a bypass door 48 pivotally connected to the base 35 to cover and uncover the opening 46 via a stop 49 as a bypass is required. The bypass door 48 is actuated by a rotary handle 50 extending through the rear wall of the stove firebox 14 and linked to the door 48 via a linking rod 52.

The catalytic combustor 28 itself is conventional, a ceramic block with a noble metal coating. As shown in FIG. 2 and demonstrated in FIG. 6, the combustor 28 is rectangular in shape to fit within the housing 24 between the walls 32 of the housing 24 downstream of the mixing screen 26 and upstream of the baffle 42. The combustor 28 is honeycombed with a plurality of air passages oriented with the defined passageway to enable the gas-air mixture to flow therethrough.

FIG. 6 also illustrates the operation of the catalytic combustor assembly 10. With the bypass door 48 closed, the volatile gases rise in the firebox 14 and are directed by the inclined base 35 of the housing 24 toward the entrance of the defined passageway. In the process of their directed flow, the volatile gases heat the housing 24, including that part defining the secondary air conduit portions 38, 40.

At the entrance of the defined passageway, secondary air drawn through the lateral portions 38 is released through the holes 41 of the transverse portion 40, as indicated by arrows 20, to mix with the overpassing volatile gases, indicated by arrows 18. This gas-air mixture encounters the mixing screen 26 and is mixed thoroughly by it before entering the catalytic combustor 28.

The combustor 28 is heated by both the housing 24 and the gas-air mixture it intercepts to burn the mixture and thereby remove most of the particulate matter therein before the mixture flows through the outlet 16 and exists the stove 12. The rate of flow of the gas-air mixture is slowed by the baffle 42 to increase the residency time of the mixture within the combustor 28.

When the bypass door 46 is pivoted to open, the volatile gases flow directly through the bypass opening to the outlet 16, rather than through the defined passageway and catalyst 28.

Having illustrated and described the principles of the invention in a preferred embodiment, it should be apparent to those skilled in the art that the invention can be modified in arrangement and detail without departing from such principles. We claim all modifications coming within the spirit and scope of the following claims.

We claim:

1. A catalytic combustor for a wood-burning stove, the stove including a flue outlet and a firebox having a ceiling and a primary air inlet for supplying primary air to the firebox, comprising:

an insertable housing having a pair of spaced-apart parallel walls having tops, the walls defining an airtight passageway for volatile gases from the firebox to the outlet, the tops of the walls shaped to engage and hermetically seal against the ceiling of the firebox surrounding the flue outlet, the housing further defining a pair of secondary air inlets and a connected U-shaped conduit having lateral portions running parallel to the housing walls and a transverse portion running between the housing walls across the entrance of the passageway to release secondary air into the passageway;

a catalytic combustor mounted within the housing across the passageway to intercept the volatile cases and burn them with the secondary air;

a bypass door pivotally mounted to a base of the housing for opening and closing a bypass opening in the base, the bypass opening allowing the volatile gases within the firebox to bypass the combustor in passing from the firebox to the flue outlet;

a mixing screen sealingly mounted within the housing across the defined passageway upstream of the catalytic combustor, the screen having a plurality of holes to promote mixing of the secondary air released from the transverse conduit and the volatile gases from the firebox; and an inclined baffle mounted within the housing across the passageway downstream of the catalytic combustor for impeding the gas flow therethrough to increase the residency time of the gases within the catalytic combustor and thereby promote a cleaner burn, the baffle positioned below the flue outlet and including an upturned tip portion for guiding the gas flow into the outlet.

2. A catalytic combustor for a wood-burning stove, the stove including a flue outlet and a firebox having a ceiling and a primary air inlet for supplying primary air to the firebox, comprising:

a housing having a pair of spaced apart walls shaped to engage the ceiling of the firebox surrounding the flue outlet, the housing walls defining an airtight passageway for volatile gases from the firebox to the flue outlet, the housing further defining a pair of secondary air inlets and a connected U-shaped conduit having lateral portions running parallel to the housing walls and a transverse portion including a plurality of holes running between the housing walls across the entrance of the passageway to release secondary air into the passageway;

a catalytic combustor mounted within the housing across the passageway to intercept the volatile gases and burn them with the secondary air;

a mixing screen mounting within the housing across the defined passageway upstream of the catalytic combustor to mix the secondary combustion air and volatile gases; and a bypass means within the housing for selectively allowing the volatile gases within the firebox to bypass the combustor in passing from the firebox to the flue outlet.

3. The combustor assembly of claim 2 in which the housing is sized to be inserted and mounted within the firebox of an existing stove.

4. The combustor assembly of claim 2 including a baffle mounted within the housing across the passageway downstream of the combustor for impeding the mixture flow to increase its residency time within the combustor and thereby promote a cleaner burn of the volatile gases.

5. A catalytic combustor assembly for a wood-burning stove, the stove including a flue outlet and a firebox having a ceiling and a primary air inlet for supplying primary air to the firebox, comprising:

a housing having a pair of spaced apart walls shaped to engage the ceiling of the firebox surrounding the flue outlet, the housing walls defining an airtight passageway for volatile gases from the firebox to the flue outlet, the housing further defining a pair of secondary air inlets and a connected U-shaped conduit having lateral portions running parallel to the housing walls and a transverse portion running between the housing walls across the entrance of the passageway to release secondary air into the passageway;

a catalytic combustor mounted within the housing across the passageway to intercept the volatile gases and burn them with secondary air;

bypass means within the housing for selectively allowing the volatile gases within the firebox to bypass the combustor in passing from the firebox to the flue outlet;

a mixing screen mounted within the housing across the defined passageway upstream of the catalytic combustor to promote mixing of the secondary air and volatile gases; and a baffle mounted within the housing across the passageway downstream of the catalytic combustor for impeding the gas flow therethrough to increase the residency time of the gases within the catalytic combustor and thereby promote a cleaner burn.

* * * * *